US011066982B2

(12) United States Patent
Tomita et al.

(10) Patent No.: US 11,066,982 B2
(45) Date of Patent: Jul. 20, 2021

(54) CENTRIFUGAL COMPRESSOR AND TURBOCHARGER

(71) Applicant: MITSUBISHI HEAVY INDUSTRIES, LTD., Tokyo (JP)

(72) Inventors: Isao Tomita, Tokyo (JP); Yoshihiro Hayashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 66 days.

(21) Appl. No.: 16/596,126

(22) Filed: Oct. 8, 2019

(65) Prior Publication Data

US 2020/0271045 A1 Aug. 27, 2020

(30) Foreign Application Priority Data

Feb. 27, 2019 (JP) ..... JP2019-033442

(51) Int. Cl.

| | |
|---|---|
| ***F04D 29/42*** | (2006.01) |
| ***F02B 33/40*** | (2006.01) |
| ***F04D 17/10*** | (2006.01) |
| ***F04D 29/28*** | (2006.01) |

(Continued)

(52) U.S. Cl.

CPC ..... *F02B 33/40* (2013.01); *F04D 17/10* (2013.01); *F04D 27/0215* (2013.01); *F04D 27/0223* (2013.01); *F04D 29/284* (2013.01); *F04D 29/4206* (2013.01); *F04D 29/4213* (2013.01); *F04D 29/685* (2013.01); *F05B 2220/40* (2013.01); *F05B 2240/14* (2013.01);

(Continued)

(58) Field of Classification Search

CPC .... F04D 15/0044; F04D 17/10; F04D 27/009; F04D 29/4206; F05D 2220/40; F05D 2240/14; F05D 2260/606

See application file for complete search history.

(56) References Cited

U.S. PATENT DOCUMENTS

| | | | | |
|---|---|---|---|---|
| 4,930,978 | A | 6/1990 | Khanna et al. | |
| 4,990,053 | A * | 2/1991 | Rohne ..... | F04D 29/685 415/58.4 |

(Continued)

FOREIGN PATENT DOCUMENTS

| | | |
|---|---|---|
| DE | 102014214226 | 1/2016 |
| DE | 102014220905 | 4/2016 |

(Continued)

*Primary Examiner* — Ninh H. Nguyen

(74) *Attorney, Agent, or Firm* — Wenderoth, Lind & Ponack, L.L.P.

(57) ABSTRACT

A centrifugal compressor operable in a wide operation range under a condition accompanied with pulsations of a pressure and a flow rate. The centrifugal compressor has a casing including at least one recirculation channel that includes a first inlet slit connected to an air flow passage on a downstream side of a leading edge in an air flow direction of the air flow passage, a second inlet slit connected to the air flow passage on a downstream side of the first inlet slit in the air flow direction of the air flow passage, a first vane disposed on a downstream side of the first inlet slit or in the first inlet slit in the at least one recirculation channel, and a second vane disposed on a downstream side of the second inlet slit or in the second inlet slit in the at least one recirculation channel.

9 Claims, 10 Drawing Sheets

(51) Int. Cl.
*F04D 27/02* (2006.01)
*F04D 29/68* (2006.01)

(52) U.S. Cl.
CPC ..... *F05B 2260/60* (2013.01); *F05D 2220/40* (2013.01); *F05D 2240/14* (2013.01)

(56) References Cited

U.S. PATENT DOCUMENTS

| | | | | |
|---|---|---|---|---|
| 6,648,594 | B1 * | 11/2003 | Horner | F04D 27/0207 415/145 |
| 7,775,759 | B2 * | 8/2010 | Sirakov | F04D 29/685 415/1 |
| 8,272,832 | B2 * | 9/2012 | Yin | F04D 29/4213 415/58.4 |
| 8,287,233 | B2 * | 10/2012 | Chen | F04D 29/4213 415/58.4 |
| 9,644,639 | B2 | 5/2017 | Duong et al. | |
| 2012/0308372 | A1 | 12/2012 | Zheng et al. | |
| 2017/0159667 | A1 | 6/2017 | Streit | |
| 2019/0154041 | A1 | 5/2019 | Benetschik et al. | |

FOREIGN PATENT DOCUMENTS

| | | |
|---|---|---|
| DE | 102017127421 | 5/2019 |
| JP | 2-136598 | 5/1990 |
| JP | 2003-074360 | 3/2003 |
| JP | 2007-224789 | 9/2007 |
| JP | 2017-110640 | 6/2017 |
| WO | 2011/099417 | 8/2011 |

* cited by examiner

CENTRIFUGAL COMPRESSOR AND TURBOCHARGER

BACKGROUND OF THE INVENTION

1. Technical Field

The present disclosure relates to a centrifugal compressor and a turbocharger.

2. Description Of The Related Art

As one of measures to expand an operation range of a centrifugal compressor, WO2011/099417A discloses a technique of disposing a recirculation channel called a casing treatment at the inlet of a casing of the centrifugal compressor. WO2011/099417A discloses that it is possible to expand a stable operation range of the centrifugal compressor to a low flow rate side by forming a recirculation channel constituted by a suction ring groove, a ring guide path, and an annular ring groove on an inner peripheral surface of the casing, and distributing the position or the width of the suction ring groove on arc in the circumferential direction in the centrifugal compressor.

SUMMARY OF THE INVENTION

Meanwhile, a centrifugal compressor used for, for example, a turbocharger for an automobile is used under a condition accompanied with time fluctuations (pulsations) of a pressure and a flow rate by an engine. It is clear from the existing document that a backflow phenomenon (surging) on a low flow rate side of a compressor is inhibited by the influence of inertia of a fluid owing to the pulsations under such a condition, and a stable operation range on the low flow rate side is expanded.

On the other hand, however, as a result of intensive research by the present inventors, it became clear that the conventional recirculation channel disclosed in WO2011/099417A is designed assuming a steady flow without any pulsation, and an effect of expanding the operation range of the centrifugal compressor is limited under the condition accompanied with such pulsations.

In view of the above, an object of at least one embodiment of the present invention is to provide a centrifugal compressor and a turbocharger which are operable in a wide operation range under the condition accompanied with the pulsations of the pressure and the flow rate.

(1) A centrifugal compressor according to at least one embodiment of the present invention includes an impeller, and a casing housing the impeller and internally forming an air flow passage to guide air to the impeller. The casing includes at least one recirculation channel for recirculating a part of the air flowing through the air flow passage from a downstream side of a leading edge of a blade of the impeller to an upstream side of the leading edge. The at least one recirculation channel includes a first inlet slit connected to the air flow passage on the downstream side of the leading edge in an air flow direction of the air flow passage, a second inlet slit connected to the air flow passage on a downstream side of the first inlet slit in the air flow direction of the air flow passage, a first vane disposed on the downstream side of the first inlet slit or in the first inlet slit in the at least one recirculation channel, and a second vane disposed on a downstream side of the second inlet slit or in the second inlet slit in the at least one recirculation channel, and $\alpha 1>\alpha 2$ is satisfied, where $\alpha 1$ is an angle between a chordwise direction of the first vane and a circumferential direction with respect to a rotational shaft of the impeller at a position of a leading edge of the first vane, and $\alpha 2$ is an angle between a chordwise direction of the second vane and the circumferential direction with respect to the rotational shaft of the impeller at a position of a leading edge of the second vane.

In the above-described centrifugal compressor, a flow angle formed by a flow direction of air flowing into each of the first vane and the second vane with respect to the circumferential direction decreases as the flow rate increases. Thus, it is possible to match the angle $\alpha 1$ of the first vane with the flow angle when the flow rate is relatively low (when the pressure ratio is high) and to match the angle $\alpha 2$ of the second vane with the flow angle when the flow rate is relatively high (when the pressure ratio is low) by setting the angle $\alpha 1$ of the first vane larger than the angle $\alpha 2$ of the second vane as described in the above configuration (1). On the other hand, the second inlet slit is connected to the air flow passage on the downstream side of the first inlet slit in the air flow direction of the air flow passage, and a differential pressure between the front and the rear of a recirculation channel is higher in a case in which air passes through the second inlet slit than in a case in which air flows through the first inlet slit. Thus, it is possible to suppress a fluctuation of a recirculation flow rate according to an operation state of the centrifugal compressor and to effectively reduce the surge flow rate of the centrifugal compressor under a pulsation condition by setting the angle $\alpha 1$ of the first vane larger than the angle $\alpha 2$ of the second vane. Thus, it is possible to expand an operation range of the centrifugal compressor to a low flow rate side and to stably operate the centrifugal compressor in a wide operation range.

(2) In some embodiments, in the centrifugal compressor according to the above configuration (1), the at least one recirculation channel includes a first recirculation channel including the first inlet slit, the second inlet slit, the first vane, and the second vane, and the first recirculation channel includes an outlet slit connected to the air flow passage on an upstream side of the leading edge of the blade in the air flow direction of the air flow passage, and an outer peripheral space portion disposed on an outer peripheral side of the air flow passage, and connected to each of the first inlet slit, the second inlet slit, and the outlet slit.

With the centrifugal compressor according to the above configuration (2), it is possible to suppress the fluctuation of the recirculation flow rate according to the operation state of the centrifugal compressor with a simple configuration and to effectively reduce the surge flow rate of the centrifugal compressor under the pulsation condition.

(3) In some embodiments, in the centrifugal compressor according to the above configuration (2), the first vane is disposed in the first inlet slit, and the second vane is disposed in the second inlet slit.

With the centrifugal compressor according to the above configuration (3), it is possible to effectively regulate the flow rate of air flowing into the first inlet slit by the first vane and to effectively regulate the flow rate of air flowing into the second inlet slit by the second vane. Thus, it is possible to suppress the fluctuation of the recirculation flow rate according to the operation state of the centrifugal compressor with the simple configuration and to effectively reduce the surge flow rate of the centrifugal compressor under the pulsation condition.

(4) In some embodiments, in the centrifugal compressor according to the above configuration (1), the at least one recirculation channel includes a first recirculation channel including the first inlet slit and the first vane, and a second recirculation channel including the second inlet slit and the second vane, the first recirculation channel includes a first outlet slit connected to the air flow passage on the upstream side of the leading edge of the blade in the air flow direction of the air flow passage, and a first outer peripheral space portion disposed on an outer peripheral side of the air flow passage and connected to each of the first inlet slit and the first outlet slit, and the second recirculation channel includes a second outlet slit connected to the air flow passage on an upstream side of the first outlet slit in the air flow direction of the air flow passage, and a second outer peripheral space portion disposed on an outer peripheral side of the first outer peripheral space portion and connected to each of the second inlet slit and the second outlet slit.

With the centrifugal compressor according to the above configuration (4), it is possible to individually adjust a channel resistance of the first recirculation channel and a channel resistance of the second recirculation channel. Thus, it is possible to effectively suppress the fluctuation of the recirculation flow rate (the total of the flow rate of the first recirculation channel and the flow rate of the second recirculation channel).

(5) In some embodiments, in the centrifugal compressor according to the above configuration (4), the first vane is disposed in the first outer peripheral space portion, and the second vane is disposed in the second outer peripheral space portion.

With the centrifugal compressor according to the above configuration (5), it is possible to suppress the fluctuation of the recirculation flow rate by disposing the first vane and the second vane without dimensional constraints of the first inlet slit, the second inlet slit, the first outlet slit, and the second outlet slit.

(6) In some embodiments, in the centrifugal compressor according to the above configuration (4) or (5), the first outlet slit has a width which is smaller than a width of the second outlet slit.

With the centrifugal compressor according to the above configuration (6), it is possible to increase a channel resistance of the first recirculation channel corresponding to the first vane which matches a flow angle at a low flow rate where the recirculation flow rate is to be decreased, and to decrease a channel resistance of the second recirculation channel corresponding to the second vane which matches the flow angle at the high flow rate where the recirculation flow rate is to be increased. Thus, it is possible to enhance an effect of suppressing the fluctuation of the recirculation flow rate.

(7) In some embodiments, in the centrifugal compressor according to any one of the above configurations (1) to (6), the first inlet slit has a width which is smaller than a width of the second inlet slit.

With the centrifugal compressor according to the above configuration (7), it is possible to increase a channel resistance of the first inlet slit corresponding to the first vane which matches the flow angle at the low flow rate where the recirculation flow rate is to be decreased, and to decrease a channel resistance of the second inlet slit corresponding to the second vane which matches the flow angle at the high flow rate where the recirculation flow rate is to be increased. Thus, it is possible to enhance the effect of suppressing the fluctuation of the recirculation flow rate.

(8) In some embodiments, in the centrifugal compressor according to any one of the above configurations (1) to (7), the first vane and the second vane are arranged so as to satisfy $10° \leq \alpha 1 - \alpha 2 \leq 25°$.

With the centrifugal compressor according to the above configuration (8), it is possible to effectively suppress the fluctuation of the recirculation flow rate according to the operation state of the centrifugal compressor. Thus, it is possible to effectively reduce the surge flow rate of the centrifugal compressor under the pulsation condition.

(9) A turbocharger according to at least one embodiment of the present invention includes a turbine, and the centrifugal compressor according to any one of the above configurations (1) to (8) connected to the turbine via a rotational shaft.

With the turbocharger according to the above configuration (9), since the turbocharger includes the centrifugal compressor according to any one of the above configurations (1) to (8), it is possible to suppress the fluctuation of the recirculation flow rate according to the operation state of the centrifugal compressor and to effectively reduce the surge flow rate of the centrifugal compressor under the pulsation condition. Thus, it is possible to expand the operation range of the centrifugal compressor to the low flow rate side and to stably operate the turbocharger in a wide operation range.

According to at least one embodiment of the present invention, a centrifugal compressor and a turbocharger are provided, which are operable in a wide operation range under a condition accompanied with pulsations of a pressure and a flow rate.

DETAILED DESCRIPTION OF THE INVENTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "contain, and "have" are not intended to be exclusive of other components.

Figure 1:
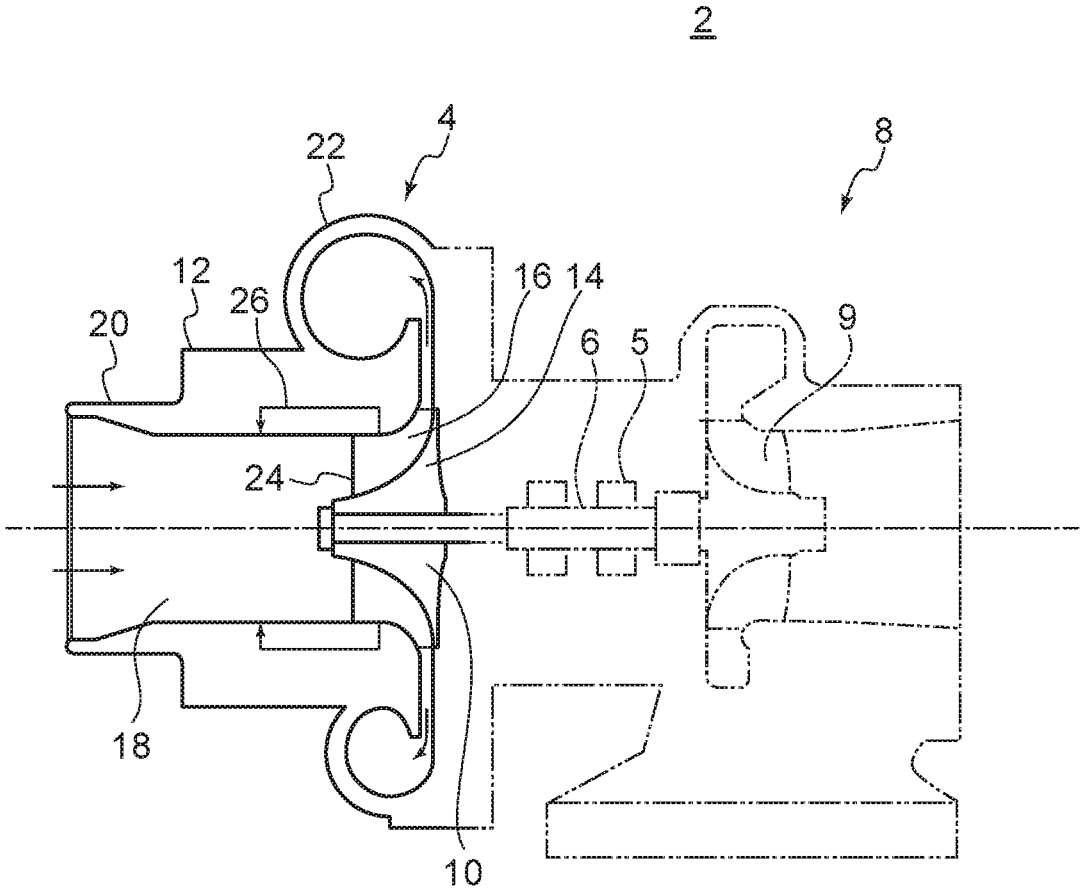
FIG. 1 is a view of the schematic configuration of a turbocharger according to an embodiment.

FIG. 1 is a view of the schematic configuration of a turbocharger 2 according to an embodiment.

As shown in FIG. 1, the turbocharger 2 includes a centrifugal compressor 4 and a turbine 8 connected to the centrifugal compressor 4 via a rotational shaft 6. The centrifugal compressor 4 includes an impeller 10 and a casing 12 housing the impeller 10. Hereinafter, the axial direction of the impeller 10 is merely referred to as the "axial direction", the radial direction of the impeller 10 is merely referred to as the "radial direction", and the circumferential direction of the impeller 10 is merely referred to as the "circumferential direction".

The impeller 10 includes a hub 14 fixed to the rotational shaft 6 and a plurality of blades 16 disposed at intervals in the circumferential direction on the outer peripheral surface of the hub 14. The impeller 10 is connected to a turbine rotor 9 of the turbine 8 via the rotational shaft 6. The impeller 10 and the turbine rotor 9 are configured to rotate integrally with each other. The rotational shaft 6 is supported rotatably by a bearing 5.

The casing 12 includes an air guide portion 20 and a scroll portion 22. The air guide portion 20 internally forms an air flow passage 18 so as to guide air to the impeller 10. The air passing through the impeller 10 flows into the scroll portion 22.

The air guide portion 20 includes at least one recirculation channel 26 (casing treatment) for recirculating a part of the air flowing through the air flow passage 18 from the downstream side of leading edges 24 of the blades 16 of the impeller 10 to the upstream side of the leading edges 24.

Figure 2:
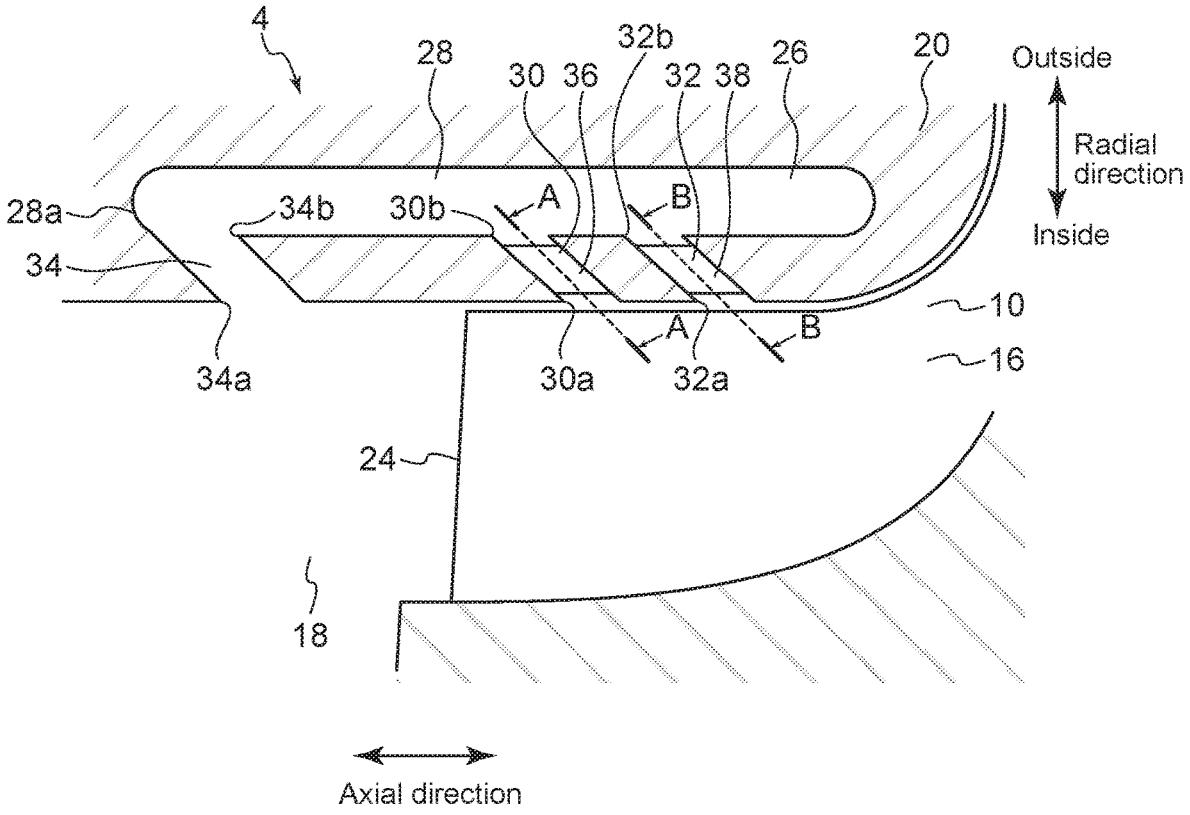
FIG. 2 is a cross-sectional view of the schematic configuration of a recirculation channel according to an embodiment.

FIG. 2 is a cross-sectional view of the schematic configuration of a recirculation channel 26 (first recirculation channel) according to an embodiment.

The recirculation channel 26 shown in FIG. 2 includes an outer peripheral space portion 28, a first inlet slit 30, a second inlet slit 32, an outlet slit 34, a plurality of first vanes 36, and a plurality of second vanes 38.

The outer peripheral space portion 28 is annularly formed on the outer peripheral side of the air flow passage 18 and extends in the axial direction.

The first inlet slit 30 is annularly formed between the air flow passage 18 and the outer peripheral space portion 28 so as to bring the air flow passage 18 and the outer peripheral space portion 28 into communication with each other in the radial direction. The first inlet slit 30 has an inner circumferential end 30*a* and an outer circumferential end 30*b*. The inner circumferential end 30*a* is connected to the air flow passage 18 on the downstream side of the leading edges 24 of the blades 16 of the impeller 10 in an air flow direction of the air flow passage 18. The outer circumferential end 30*b* is connected to the outer peripheral space portion 28.

The second inlet slit 32 is annularly formed between the air flow passage 18 and the outer peripheral space portion 28 so as to bring the air flow passage 18 and the outer peripheral space portion 28 into communication with each other in the radial direction. The second inlet slit 32 has an inner circumferential end 32*a* and an outer circumferential end 32*b*. The inner circumferential end 32*a* is connected to the air flow passage 18 on the downstream side of the first inlet slit 30 in the air flow direction of the air flow passage 18. The outer circumferential end 32*b* is connected to the outer peripheral space portion 28 on the upstream side of the first inlet slit 30 in the air flow direction of the outer peripheral space portion 28.

The outlet slit 34 is annularly formed between the air flow passage 18 and the outer peripheral space portion 28 so as to bring the air flow passage 18 and the outer peripheral space portion 28 into communication with each other in the radial direction. The outlet slit 34 has an inner circumferential end 34*a* and an outer circumferential end 34*b*. The inner circumferential end 34*a* is connected to the air flow passage 18 on the upstream side of the leading edges 24 of the blades 16 of the impeller 10 in the air flow direction of the air flow passage 18. The outer circumferential end 34*b* is connected to the outer peripheral space portion 28 on the downstream side of the first inlet slit 30 in the air flow direction of the outer peripheral space portion 28 (in the depicted embodiment, at a downstream end part 28*a* of the outer peripheral space portion 28 in the air flow direction of the outer peripheral space portion 28).

Figure 3:
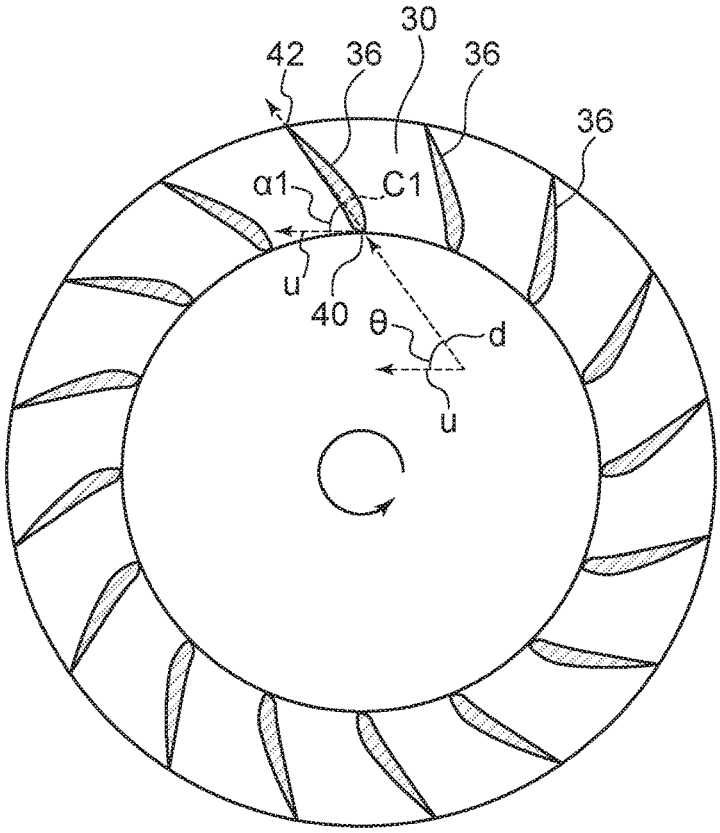
FIG. 3 is a view of a cross section of first vanes each taken along a line A-A in FIG. 2 as viewed in the axial direction (a cross section along the center position of each of the first vanes in the axial direction).
Figure 4:
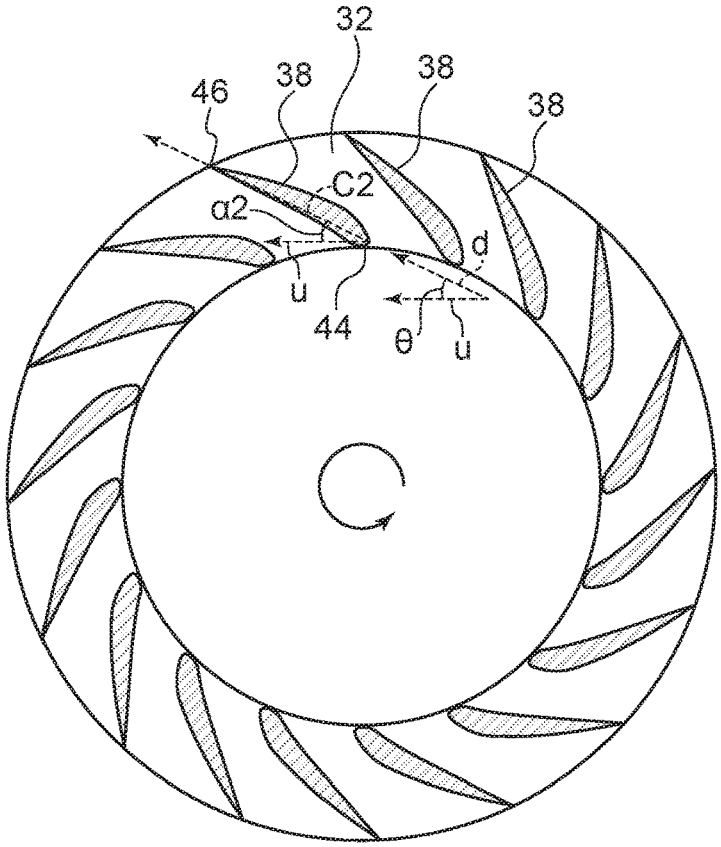
FIG. 4 is a view of a cross section of second vanes each taken along a line B-B in FIG. 2 as viewed in the axial direction (a cross section along the center position of each of the second vanes in the axial direction).

FIG. 3 is a view of a cross section of the first vanes 36 each taken along a line A-A in FIG. 2 as viewed in the axial direction (a cross section along the center position of each of the first vanes 36 in the axial direction). FIG. 4 is a view of a cross section of the second vanes 38 each taken along a line B-B in FIG. 2 as viewed in the axial direction (a cross section along the center position of each of the second vanes 38 in the axial direction).

As shown in FIG. 3, the plurality of first vanes 36 are disposed at intervals in the circumferential direction in the first inlet slit 30. Further, as shown in FIG. 4, the plurality of second vanes 38 are disposed at intervals in the circumferential direction in the second inlet slit 32.

The first vane 36 and the second vane 38 are arranged so as to satisfy $\alpha 1>\alpha 2$, where $\alpha 1$ is an angle between a tangential direction u of a rotation speed of the impeller 10 at the position of a leading edge 40 of the first vane 36 (the circumferential direction with respect to the rotational shaft 6 of the impeller 10) and a chordwise direction C1 of the first vane 36 (a direction to link the leading edge 40 and a trailing edge 42 of the first vane 36, the leading edge 40 being designated as a starting point) in a cross section shown in FIG. 3, and $\alpha 2$ is an angle between the tangential direction u of a rotation speed of the impeller 10 at the position of a leading edge 44 of the second vane 38 (the circumferential direction with respect to the rotational shaft 6 of the impeller 10) and a chordwise direction C2 of the second vane 38 (a direction to link the leading edge 44 and a trailing edge 46 of the second vane 38, the leading edge 44 being designated as a starting point) in a cross section shown in FIG. 4. The angle $\alpha 1$ and the angle $\alpha 2$ may be set so as to satisfy, for example, $10° \leq \alpha 1-\alpha 2 \leq 25°$.

Since the first vane 36 and the second vane 38 are arranged so as to satisfy $\alpha 1>\alpha 2$ as described above, it is possible to reduce a surge flow rate and expand an operation range to a low flow rate side, and to stably operate the centrifugal compressor 4 in a wide operation range under a condition accompanied with pulsations of a pressure and a flow rate by an engine (not shown).

The reasons why it is possible to obtain the above-described effects will be described below with discussions about the reference embodiment.

A centrifugal compressor used for a turbocharger for an automobile is used under a condition accompanied with time fluctuations (pulsations) of a pressure and a flow rate by an engine. Surging characteristics at this time demonstrates a different tendency relative to a compressor unit test (bench test) under a condition accompanied with no pulsation. That is, under the pulsation condition, the surge flow rate tends to be reduced relative to the compressor unit test (steady condition).

A factor in reducing the surge flow rate under the pulsation condition is the influence of inertia dm/dt of a fluid generated by a time fluctuation of a mass flow rate m[kg/s] of an impeller inlet. It is considered that the time fluctuation of the flow rate becomes steep due to pulsation, increasing the inertia, and a backflow from an impeller outlet is inhibited, causing less surge.

Figure 5:
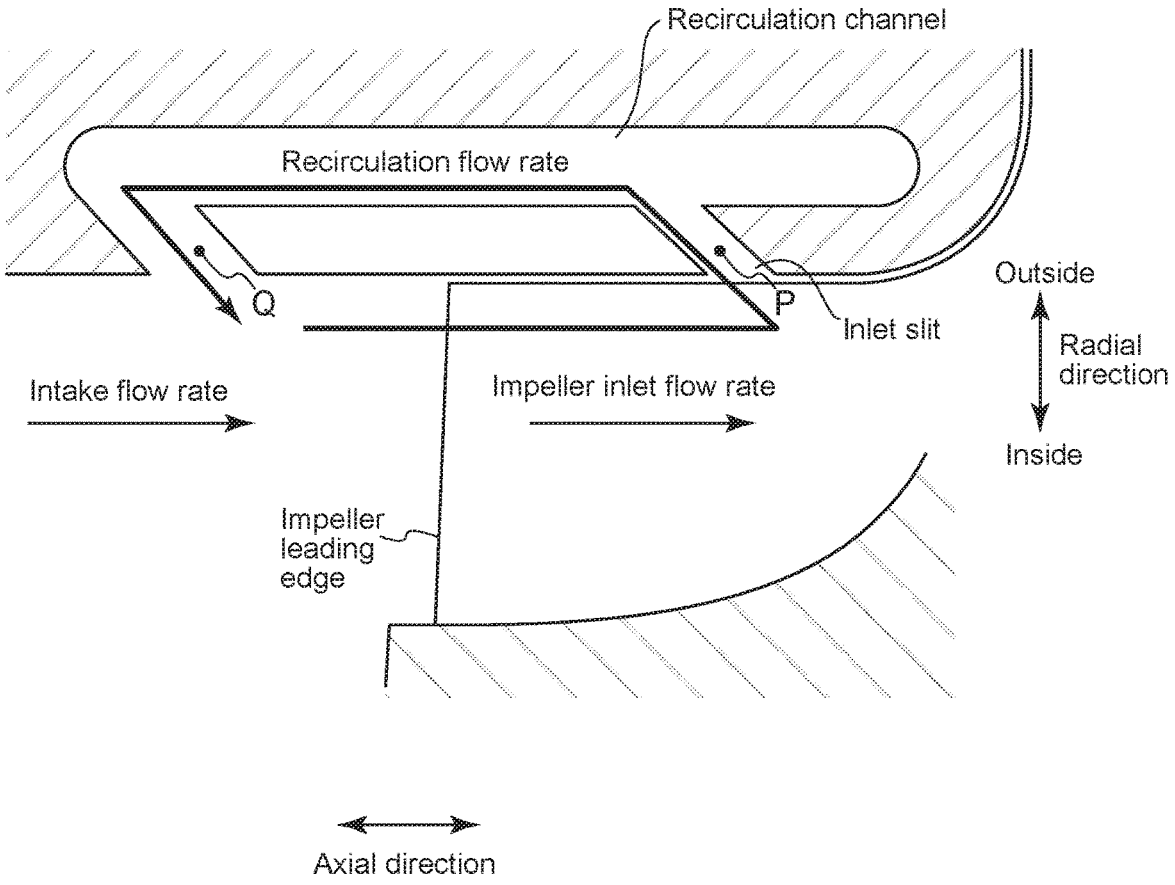
FIG. 5 is a schematic view of the configuration of a recirculation channel (casing treatment) according to a reference embodiment.

FIG. 5 is a schematic view of the configuration of a recirculation channel (casing treatment) according to the reference embodiment. In the reference embodiment shown in FIG. 5, only one recirculation channel having only one inlet slit is disposed.

Figure 6:
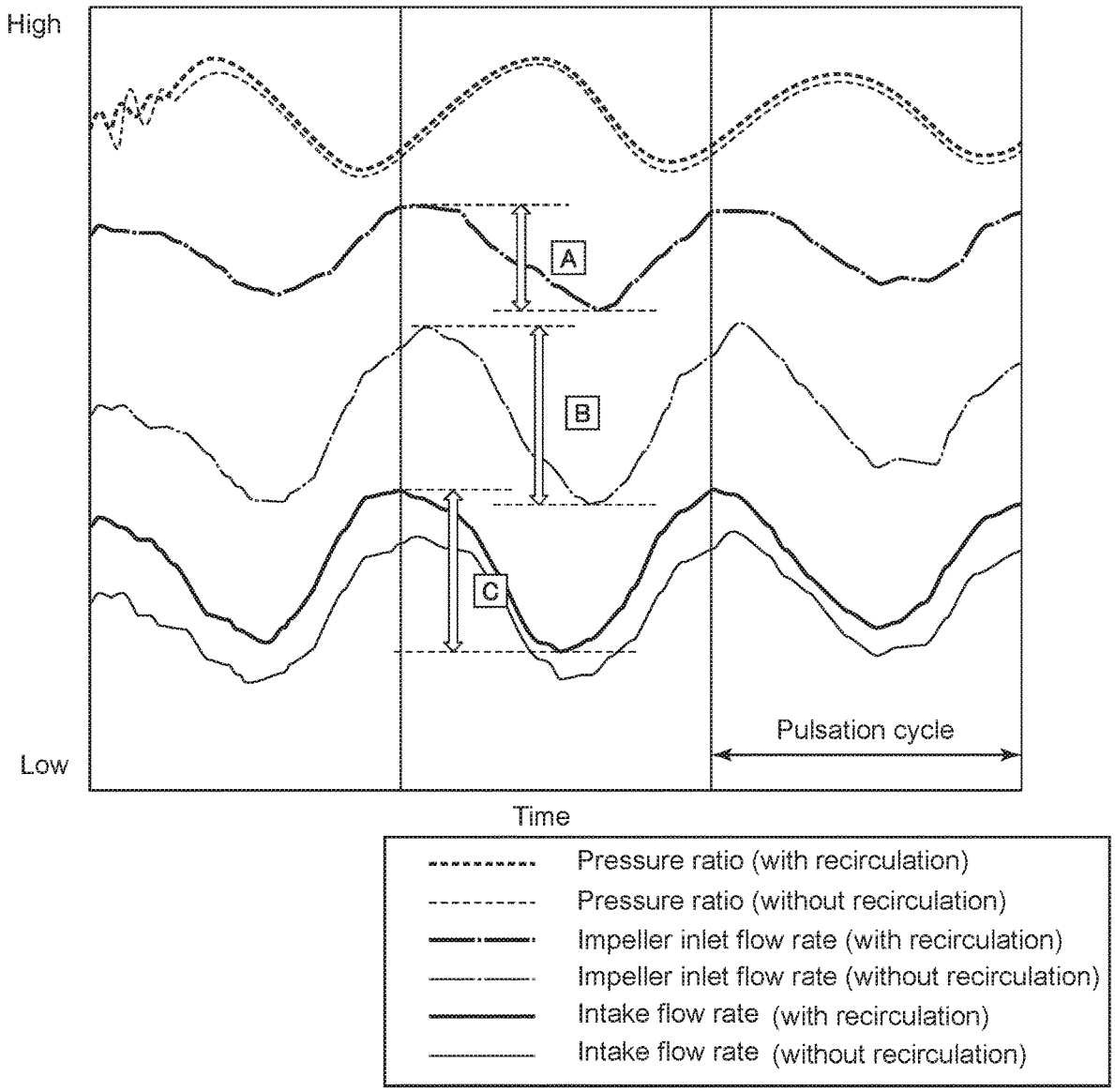
FIG. 6 is a chart of the result of an unsteady analysis obtained by adding a pressure fluctuation to an outlet boundary of the compressor.

FIG. 6 is a chart of the result of an unsteady analysis obtained by adding a pressure fluctuation to an outlet boundary of the compressor.

In FIG. 6, a solid line indicates a temporal change of an intake flow rate (a flow rate on an inlet boundary of the centrifugal compressor) of the centrifugal compressor, a single-dotted chain line indicates a temporal change of a flow rate at the impeller inlet, and a dashed line indicates a temporal change of a pressure ratio. In addition, regarding each of the lines, a thick line indicates a case with the recirculation channel shown in FIG. 5, and a thin line indicates a case without the recirculation channel.

As shown in FIG. 6, an amplitude A of the flow rate at the impeller inlet in the case with the recirculation channel is lower than an amplitude B of the flow rate at the impeller inlet in the case without the recirculation channel. Thus, the effect of reducing surge by pulsation is considered to be smaller in the case with the recirculation channel. On the other hand, an amplitude C of the intake flow rate is substantially the same in spite of the presence or absence of the recirculation channel. Since the flow rate at the impeller inlet is represented by a sum of the intake flow rate and a recirculation flow rate from the recirculation channel, the amplitude A of the flow rate at the impeller inlet is considered to be decreased as compared with the amplitude B as a result that the recirculation flow rate fluctuates in an opposite phase to the intake flow rate. Thus, the effect of the inertia dm/dt serving as a factor in improving surge under the pulsation condition attenuates, limiting a surge improving effect.

A difference between the amplitudes of the flow rate at the inlet under the pulsation condition according to the presence or absence of the recirculation channel can be described by the following theory.

First, as the first premise, the recirculation flow rate of the recirculation channel changes in accordance with a pressure state at the outlet of the centrifugal compressor. In addition, as the second premise, the flow rate becomes minimum at a pressure maximum point, and the flow rate becomes maximum at a pressure minimum point because of P-Q characteristics of a general centrifugal compressor.

On the basis of these premises, at a point where the intake flow rate becomes maximum, a differential pressure between the front and the rear of the recirculation channel (a differential pressure between a point P and a point Q in FIG. 5) is decreased due to a pressure decrease at the outlet of the compressor, and the recirculation flow rate is decreased. On the other hand, a point where the intake flow rate becomes minimum, the differential pressure between the front and the rear of the recirculation channel is increased due to a pressure increase at the outlet, and the recirculation flow rate is increased. Since the flow rate at the impeller inlet is defined as the sum of the intake flow rate and the recirculation flow rate, the amplitude of the flow rate of air passing inside the impeller is decreased as a result that a change in the recirculation flow rate acts to cancel a change in the intake flow rate.

From the above-described theory, it is considered that it is possible to suppress the attenuation of the inertia caused by the flow-rate fluctuation at the impeller inlet and to effectively reduce the surge flow rate of the centrifugal compressor under the pulsation condition if the structure of the recirculation channel with less fluctuation of the recirculation flow rate under the pulsation condition is designed.

In view of the above, considering the configuration shown in FIG. 2, regarding a static-pressure distribution in the flow direction of the air flow passage 18, since the differential pressure between the front and the rear of the recirculation channel increases as the inlet slits of the recirculation channel 26 are positioned on the more downstream side, it is considered that the fluctuation of the recirculation flow rate can be suppressed as compared with the fluctuation of the pressure ratio by allowing air to easily pass through the first inlet slit 30 on the upstream side at the low flow rate and allowing air to easily pass through the second inlet slit 32 on the downstream side at the high flow rate.

Thus, as shown in FIGS. 3 and 4, the first vane 36 and the second vane 38 are arranged so as to satisfy $\alpha 1>\alpha 2$. In the centrifugal compressor 4, a flow angle $\theta$ formed by a flow direction d of air flowing into each of the first vane 36 and the second vane 38 with respect to the tangential direction u of the rotation speed of the impeller 10 decreases as the flow rate increases. Thus, it is possible to match the angle $\alpha 1$ of the first vane 36 with the flow angle $\theta$ at the low flow rate and to match the angle $\alpha 2$ of the second vane 38 with the flow angle $\theta$ at the high flow rate under the pulsation condition by setting the appropriate angle $\alpha 1$ and angle $\alpha 2$ which satisfy $\alpha 1 > \alpha 2$.

Figure 7:
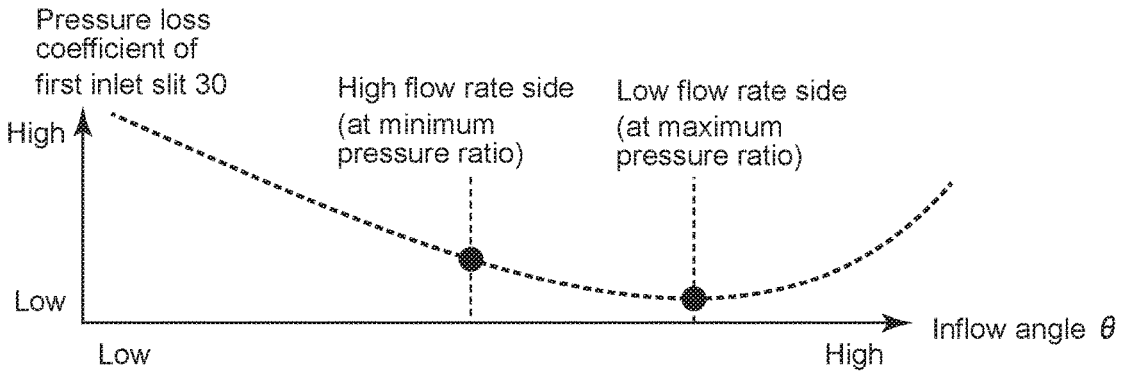
FIG. 7 is a graph of the schematic relationship between an inflow angle θ and a pressure loss coefficient of a first inlet slit.
Figure 8:
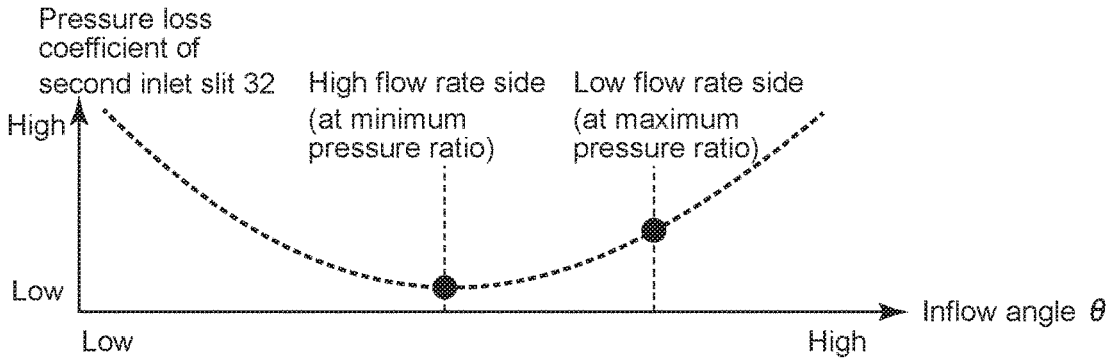
FIG. 8 is a graph of the schematic relationship between the inflow angle θ and a pressure loss coefficient of a second inlet slit.
Figure 9:
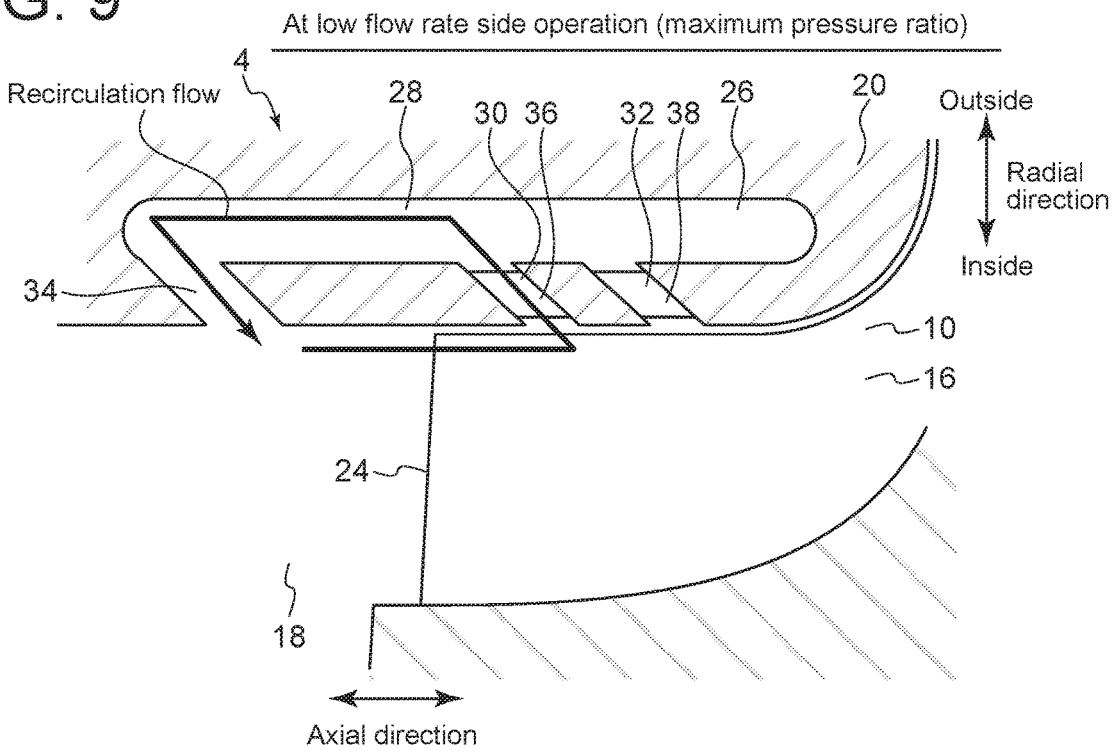
FIG. 9 is a view for describing a flow at the time of an operation on the low flow rate side (at the time of a maximum pressure ratio) in the recirculation channel.
Figure 10:
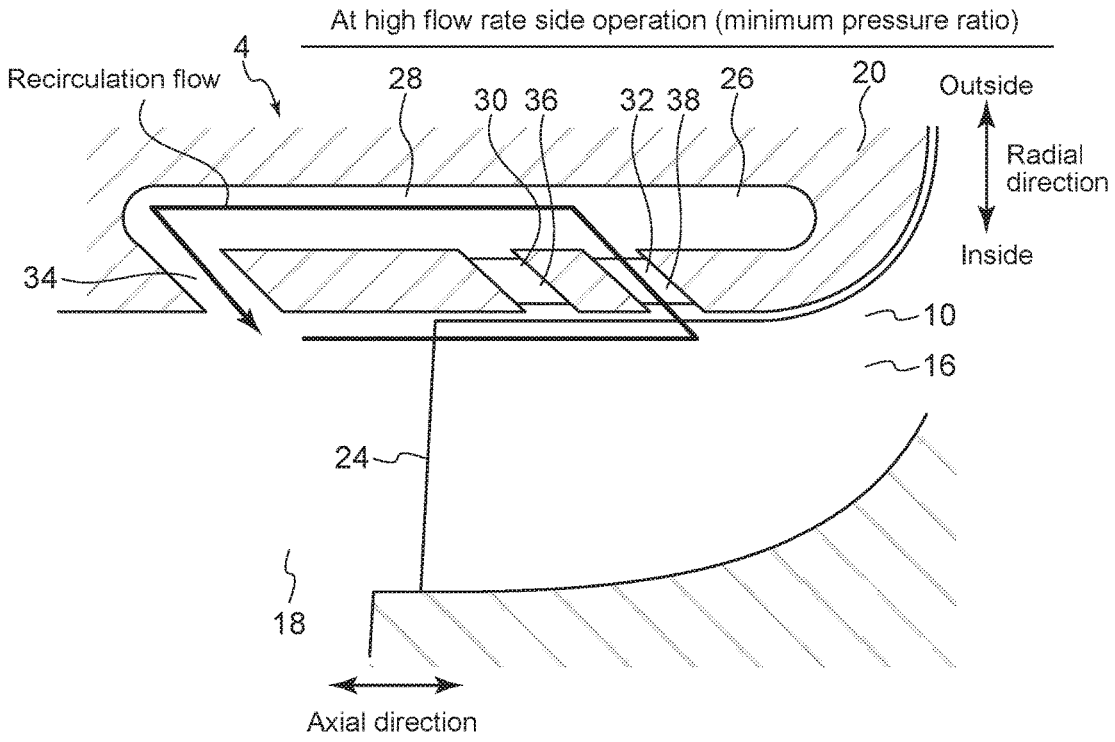
FIG. 10 is a view for describing a flow at the time of an operation on the high flow rate side (at the time of a minimum pressure ratio) in the recirculation channel.

For example, the angle $\alpha 1$ of the first vane 36 may relatively be set large so that a pressure loss coefficient of the first inlet slit 30 becomes minimum when the flow rate is minimum (when the pressure ratio is maximum) as shown in FIG. 7, and the angle $\alpha 2$ of the second vane 38 may be set smaller than the angle $\alpha 1$ so that a pressure loss coefficient of the second inlet slit 32 becomes minimum when the flow rate is maximum (when the pressure ratio is minimum) as shown in FIG. 8. Thus, it is possible to allow air to easily flow through the first inlet slit 30 having small pressure difference from the outlet slit 34 at the low flow rate as shown in FIG. 9, and to allow air to easily flow through the second inlet slit 32 having a large pressure difference from the outlet slit 34 at the high flow rate as shown in FIG. 10.

Figure 11:
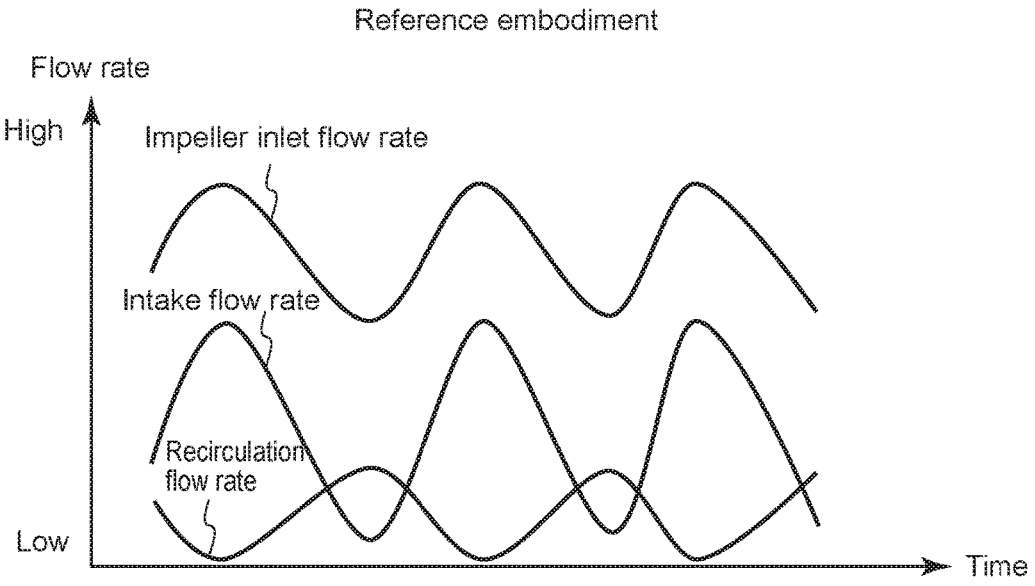
FIG. 11 is a graph schematically showing fluctuations of an impeller inlet flow rate, an intake flow rate, and a recirculation flow rate in the centrifugal compressor according to the reference embodiment.
Figure 12:
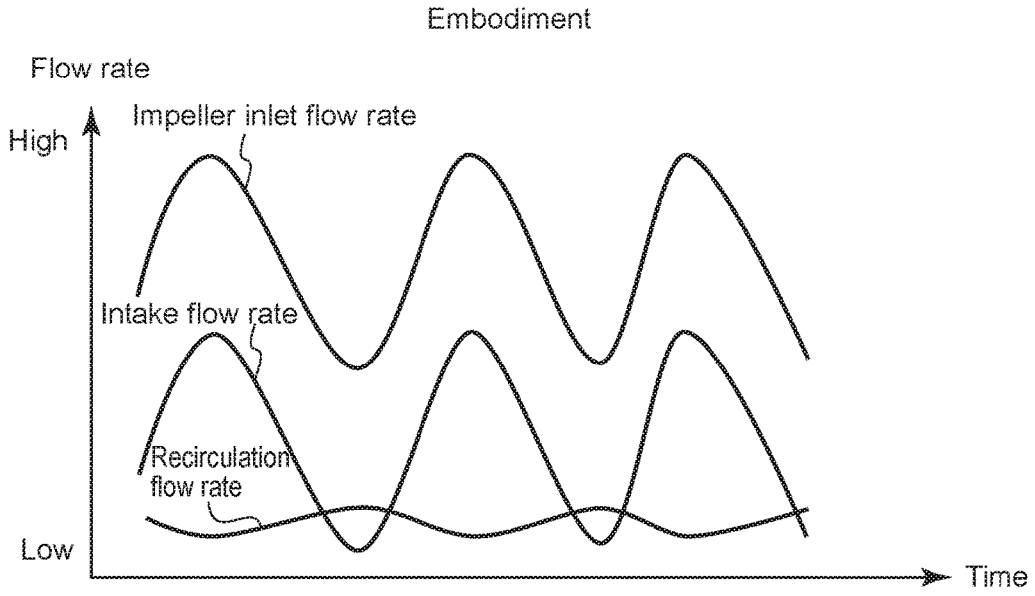
FIG. 12 is a graph schematically showing fluctuations of the impeller inlet flow rate, the intake flow rate, and the recirculation flow rate in a centrifugal compressor.

The slits 30, 32 with which the flow angle $\theta$ matches are switched in accordance with an operation point of the centrifugal compressor 4 under the pulsation condition by thus setting the appropriate angle $\alpha 1$ and angle $\alpha 2$ which satisfy $\alpha 1 > \alpha 2$, making it possible to suppress the fluctuation of the recirculation flow rate according to an operation state of the centrifugal compressor 4 and to maintain the flow-rate fluctuation at the impeller inlet in the embodiment as shown in FIGS. 11 and 12 as compared with the centrifugal compressor according to the reference embodiment (see FIG. 5). Thus, it is possible to ensure the effect of the inertia dm/dt of the fluid under the pulsation condition, to effectively reduce the surge flow rate and expand the operation range to the low flow rate side, and to stably operate the centrifugal compressor 4 in the wide operation range.

In a case in which the first vane 36 and the second vane 38 are not disposed in the above-described embodiment, the magnitude relationship between the pressure loss coefficient of the first inlet slit 30 and the pressure loss coefficient of the second inlet slit 32 does not change even if the flow angle $\theta$ varies, and thus it is impossible to effectively suppress the fluctuation of the recirculation flow rate.

Figure 13:
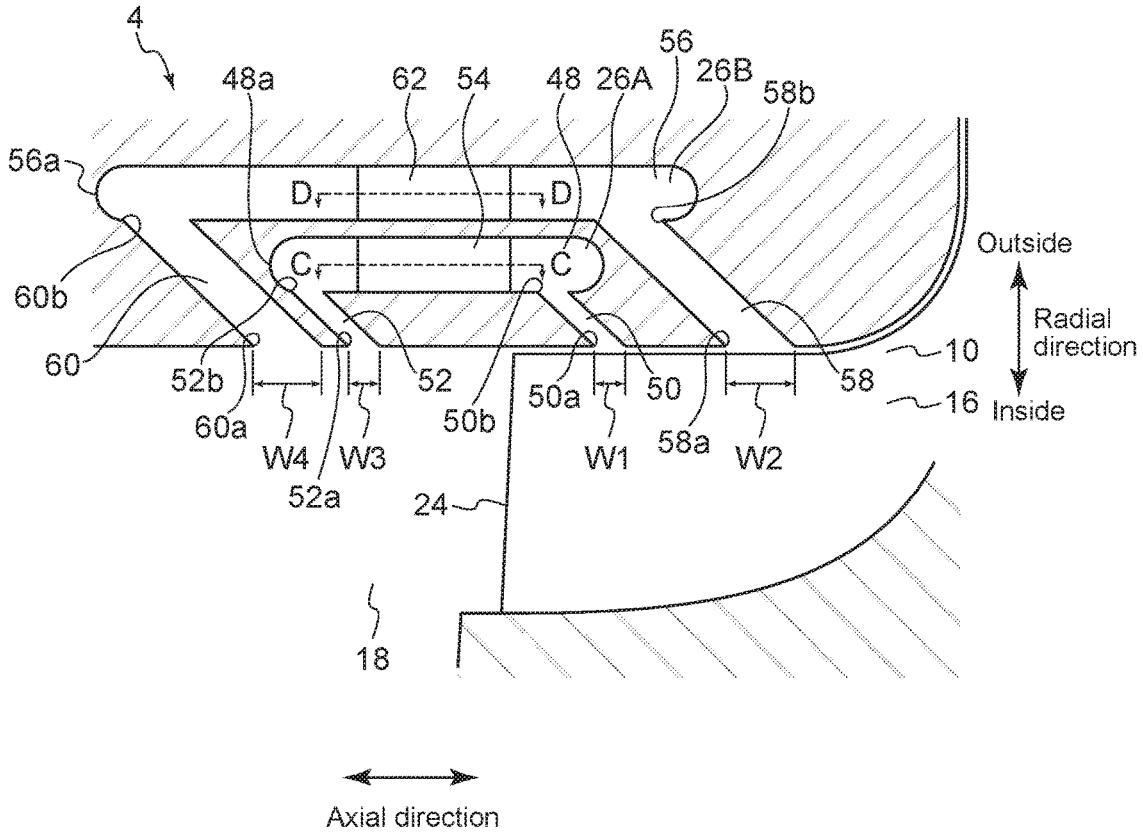
FIG. 13 is a cross-sectional view of the schematic configuration of two recirculation channels according to an embodiment.

FIG. 13 is a cross-sectional view of the schematic configuration of two recirculation channels 26 (26A, 26B) according to an embodiment. In the embodiment shown in FIG. 13, the casing 12 includes the first recirculation channel 26A and the second recirculation channel 26B doubly installed in the radial direction.

The first recirculation channel 26A includes a first outer peripheral space portion 48, a first inlet slit 50, a first outlet slit 52, and a plurality of first vanes 54. The first outer peripheral space portion 48 is annularly formed on the outer peripheral side of the air flow passage 18 and extends in the axial direction.

The first inlet slit 50 is annularly formed between the air flow passage 18 and the first outer peripheral space portion 48 so as to bring the air flow passage 18 and the first outer peripheral space portion 48 into communication with each other in the radial direction. The first inlet slit 50 has an inner circumferential end 50*a* and an outer circumferential end 50*b*. The inner circumferential end 50*a* is connected to the air flow passage 18 on the downstream side of the leading edges 24 of the blades 16 of the impeller 10 in the air flow direction of the air flow passage 18. The outer circumferential end 50*b* is connected to the first outer peripheral space portion 48.

The first outlet slit 52 is annularly formed between the air flow passage 18 and the first outer peripheral space portion 48 so as to bring the air flow passage 18 and the first outer peripheral space portion 48 into communication with each other in the radial direction. The first outlet slit 52 has an inner circumferential end 52*a* and an outer circumferential end 52*b*. The inner circumferential end 52*a* is connected to the air flow passage 18 on the upstream side of the leading edges 24 of the blades 16 in the air flow direction of the air flow passage 18. The outer circumferential end 52*b* is connected to the first outer peripheral space portion 48 on the downstream side of the first inlet slit 50 in the air flow direction of the first outer peripheral space portion 48 (in the depicted embodiment, at a downstream end part 48*a* of the first outer peripheral space portion 48 in the air flow direction of the first outer peripheral space portion 48).

The second recirculation channel 26B includes a second outer peripheral space portion 56, a second inlet slit 58, a second outlet slit 60, and a plurality of second vanes 62. The second outer peripheral space portion 56 is annularly formed on the outer peripheral side of the first outer peripheral space portion 48 and extends in the axial direction.

The second inlet slit 58 is annularly formed between the air flow passage 18 and the second outer peripheral space portion 56 so as to bring the air flow passage 18 and the second outer peripheral space portion 56 into communication with each other in the radial direction. The second inlet slit 58 has an inner circumferential end 58*a* and an outer circumferential end 58*b*. The inner circumferential end 58*a* is connected to the air flow passage 18 on the downstream side of the first inlet slit 30 in the air flow direction of the air flow passage 18. The outer circumferential end 58*b* is connected to the second outer peripheral space portion 56. A slit width W2 of the second inlet slit 58 in the axial direction is set larger than a slit width W1 of the first inlet slit 50 in the axial direction.

The second outlet slit 60 is annularly formed between the air flow passage 18 and the second outer peripheral space portion 56 so as to bring the air flow passage 18 and the second outer peripheral space portion 56 into communication with each other in the radial direction. The second outlet slit 60 has an inner circumferential end 60*a* and an outer circumferential end 60*b*. The inner circumferential end 60*a* is connected to the air flow passage 18 on the upstream side of the second inlet slit 58 in the air flow direction of the air flow passage 18. The outer circumferential end 60*b* is connected to the second outer peripheral space portion 56 on the downstream side of the second inlet slit 58 in the air flow direction of the second outer peripheral space portion 56 (in the depicted embodiment, at a downstream end part 56*a* of the second outer peripheral space portion 56 in the air flow direction of the second outer peripheral space portion 56). A slit width W4 of the second outlet slit 60 in the axial direction is set larger than a slit width W3 of the first outlet slit 52 in the axial direction.

Figure 14:
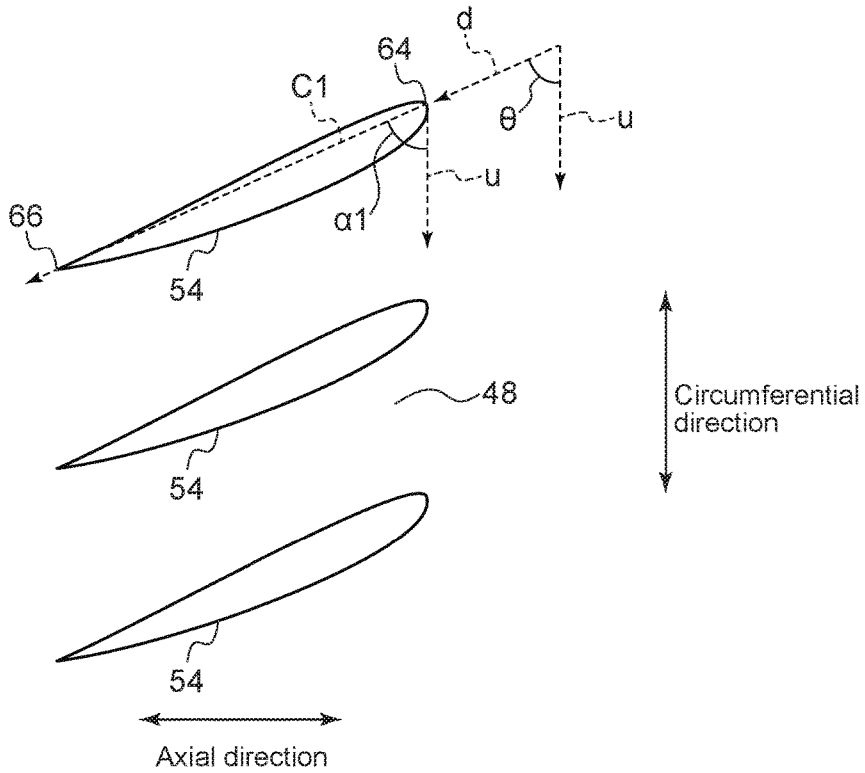
FIG. 14 is a blade-row expanded view of a cross section of first vanes each taken along a line C-C in FIG. 13 (a cross section along the center position of each of the first vanes in the radial direction).
Figure 15:
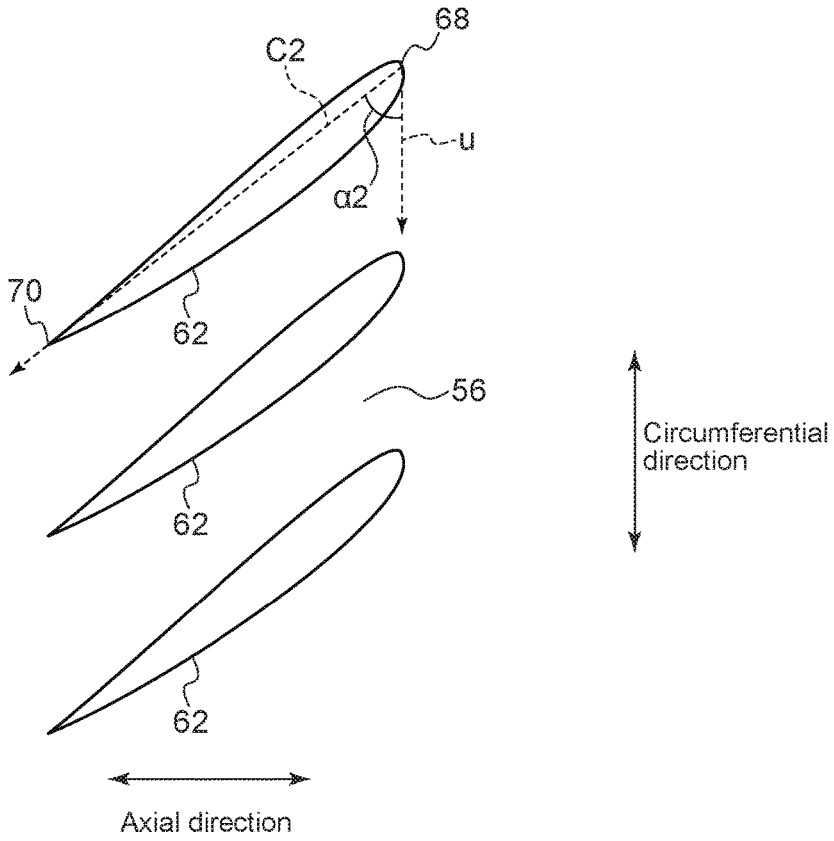
FIG. 15 is a blade-row expanded view of a cross section of second vanes 62 each taken along a line D-D in FIG. 13 (a cross section along the center position of each of the second vanes in the radial direction).

FIG. 14 is a blade-row expanded view of a cross section of the first vanes 54 each taken along a line C-C in FIG. 13 (a cross section along the center position of each of the first vanes 54 in the radial direction). FIG. 15 is a blade-row expanded view of a cross section of second vanes 62 each taken along a line D-D in FIG. 13 (a cross section along the center position of each of the second vanes 62 in the radial direction).

As shown in FIG. 14, the plurality of first vanes 54 are disposed at intervals in the circumferential direction in the first outer peripheral space portion 48. Further, as shown in FIG. 15, the plurality of second vanes 62 are disposed at intervals in the circumferential direction in the second outer peripheral space portion 56.

The first vane 54 and the second vane 62 are arranged so as to satisfy $\alpha1>\alpha2$, where $\alpha1$ is the angle between the tangential direction u of the rotation speed of the impeller 10 at the position of a leading edge 64 of the first vane 54 (the circumferential direction with respect to the rotational shaft 6 of the impeller 10) and the chordwise direction C1 of the first vane 36 (a direction to link the leading edge 64 and a trailing edge 66 of the first vane 54, the leading edge 64 being designated as a starting point) as shown in FIG. 14, and $\alpha2$ is the angle between the tangential direction u of the rotation speed of the impeller 10 at the position of a leading edge 68 of the second vane 62 (the circumferential direction with respect to the rotational shaft 6 of the impeller 10) and the chordwise direction C2 of the second vane 62 (a direction to link the leading edge 68 and a trailing edge 70 of the second vane 62, the leading edge 68 being designated as a starting point) as shown in FIG. 15.

In the configuration shown in FIG. 13, a differential pressure between the front and the rear of the second recirculation channel 26B (a differential pressure between the second inlet slit 58 and the second outlet slit 60) is higher than a differential pressure between the front and the rear of the first recirculation channel 26A (a differential pressure between the first inlet slit 50 and the first outlet slit 52). Thus, the angle $\alpha1$ is set so as to match the flow angle $\theta$ when the flow rate is minimum (when the pressure ratio is maximum), and the angle $\alpha2$ is set smaller than the angle $\alpha1$ so as to match the flow angle $\theta$ when the flow rate is maximum (when the pressure ratio is minimum), making it possible to minimize the pressure loss coefficient of the first recirculation channel 26A when the flow rate is minimum, and to minimize the pressure loss coefficient of the second recirculation channel 26B when the flow rate is maximum.

Since the recirculation channels 26A, 26B with which the flow angle $\theta$ matches are thus switched in accordance with the operation point of the centrifugal compressor 4, it is possible to suppress the fluctuation of the recirculation flow rate according to the operation state of the centrifugal compressor 4 and to effectively reduce the surge flow rate of the centrifugal compressor 4 under the pulsation condition as compared with the centrifugal compressor according to the reference embodiment (see FIG. 5). Thus, it is possible to expand the operation range of the centrifugal compressor 4 to the low flow rate side and to stably operate the centrifugal compressor 4 in the wide operation range.

Moreover, as described above, the slit width W1 of the first inlet slit 50 is set smaller than the slit width W2 of the second inlet slit 58, and the slit width W3 of the first outlet slit 52 is set smaller than the slit width W4 of the second outlet slit 60. Thus, a channel resistance of the first recirculation channel 26A corresponding to the first vanes 54 which matches the flow angle $\theta$ at the low flow rate where the recirculation flow rate is to be decreased is increased, a channel resistance of the second recirculation channel 26B corresponding to the second vanes 62 which matches the flow angle $\theta$ at the high flow rate where the recirculation flow rate is to be increased is decreased. Thus, it is possible to enhance an effect of suppressing the fluctuation of the recirculation flow rate to equalize the recirculation flow rate. However, from viewpoints of manufacturability and packaging of the casing 12, the embodiment shown in FIG. 2 is more advantageous than the embodiment shown in FIG. 13.

The present invention is not limited to the above-described embodiment, and also includes an embodiment obtained by modifying the above-described embodiment and an embodiment obtained by combining these embodiments as appropriate.

The invention claimed is:

1. A centrifugal compressor comprising:

an impeller; and a casing housing the impeller and internally forming an air flow passage to guide air to the impeller, wherein the casing includes at least one recirculation channel for recirculating a part of the air flowing through the air flow passage from a downstream side of a leading edge of a blade of the impeller to an upstream side of the leading edge, wherein the at least one recirculation channel includes:

a first inlet slit connected to the air flow passage on the downstream side of the leading edge in an air flow direction of the air flow passage;

a second inlet slit connected to the air flow passage on a downstream side of the first inlet slit in the air flow direction of the air flow passage;

a first vane disposed on the downstream side of the first inlet slit or in the first inlet slit in the at least one recirculation channel; and a second vane disposed on a downstream side of the second inlet slit or in the second inlet slit in the at least one recirculation channel, and wherein $\alpha1>\alpha2$ is satisfied, where $\alpha1$ is an angle between a chordwise direction of the first vane and a circumferential direction with respect to a rotational shaft of the impeller at a position of a leading edge of the first vane, and $\alpha2$ is an angle between a chordwise direction of the second vane and the circumferential direction with respect to the rotational shaft of the impeller at a position of a leading edge of the second vane.

2. The centrifugal compressor according to claim 1, wherein the at least one recirculation channel includes a first recirculation channel including the first inlet slit, the second inlet slit, the first vane, and the second vane, and wherein the first recirculation channel includes:

an outlet slit connected to the air flow passage on an upstream side of the leading edge of the blade in the air flow direction of the air flow passage; and an outer peripheral space portion disposed on an outer peripheral side of the air flow passage, and connected to each of the first inlet slit, the second inlet slit, and the outlet slit.

3. The centrifugal compressor according to claim 2, wherein the first vane is disposed in the first inlet slit, and the second vane is disposed in the second inlet slit.

4. The centrifugal compressor according to claim 1, wherein the at least one recirculation channel includes a first recirculation channel including the first inlet slit and the first vane, and a second recirculation channel including the second inlet slit and the second vane, wherein the first recirculation channel includes a first outlet slit connected to the air flow passage on the upstream side of the leading edge of the blade in the air flow direction of the air flow passage, and a first outer peripheral space portion disposed on an outer peripheral side of the air flow passage and connected to each of the first inlet slit and the first outlet slit, and wherein the second recirculation channel includes a second outlet slit connected to the air flow passage on an upstream side of the first outlet slit in the air flow direction of the air flow passage, and a second outer peripheral space portion disposed on an outer peripheral side of the first outer peripheral space portion and connected to each of the second inlet slit and the second outlet slit.

5. The centrifugal compressor according to claim 4, wherein the first vane is disposed in the first outer peripheral space portion, and the second vane is disposed in the second outer peripheral space portion.

6. The centrifugal compressor according to claim 4, wherein the first outlet slit has a width which is smaller than a width of the second outlet slit.

7. The centrifugal compressor according to claim 1, wherein the first inlet slit has a width which is smaller than a width of the second inlet slit.

8. The centrifugal compressor according to claim 1, wherein the first vane and the second vane are arranged so as to satisfy $10° \leq \alpha 1 - \alpha 2 \leq 25°$.

9. A turbocharger comprising:

a turbine; and the centrifugal compressor according to claim 1 connected to the turbine via a rotational shaft.

* * * * *